US008444745B2

(12) United States Patent
Demetriou et al.

(10) Patent No.: US 8,444,745 B2
(45) Date of Patent: May 21, 2013

(54) AMORPHOUS METAL FOAM AS A PROPERTY-MATCHED BONE SCAFFOLD SUBSTITUTE

(75) Inventors: Marios D. Demetriou, Los Angeles, CA (US); John S. Harmon, San Mateo, CA (US); William L. Johnson, Pasadena, CA (US); Chris Veazey, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 242 days.

(21) Appl. No.: 11/891,992

(22) Filed: Aug. 13, 2007

(65) Prior Publication Data

US 2008/0060725 A1 Mar. 13, 2008

Related U.S. Application Data

(60) Provisional application No. 60/837,176, filed on Aug. 11, 2006.

(51) Int. Cl.
*C22C 45/00* (2006.01)
*C22C 1/08* (2006.01)

(52) U.S. Cl.
USPC ..... 75/415; 148/403; 148/561; 164/79

(58) Field of Classification Search
None
See application file for complete search history.

(56) References Cited

U.S. PATENT DOCUMENTS 4,915,980 A 4/1990 Matsunawa et al.
5,306,309 A 4/1994 Wagner et al.
2002/0106611 A1* 8/2002 Bhaduri et al. ..... 433/201.1
2004/0035502 A1 2/2004 Kang et al.
2005/0084407 A1 4/2005 Myrick
2007/0267167 A1* 11/2007 Kang ..... 164/479

OTHER PUBLICATIONS

Schroers, J. et al., "Amorphous Metallic Foam", Applied Physics Letters, vol. 82, No. 3, Jan. 20, 2003, pp. 370-372.*

Gibson, L.J., "The Mechanical Behavor of Cancellous Bone", J. of Biomechanics, vol. 18, pp. 317-328, 1985.*

Hodgskinson, R. et al., "Young's modulus, density and material properties in cancellous bone over a large density range", J. of Materials Science: Materials in Medicine 3, pp. 377-381, 1982.*

Demetriou, M.D. et al., "Stochastic Metallic-Glass Cellular Structures Exhibiting Benchmark Strength", Physical Review Letters, vol. 101, pp. 145702-1-145702-3, Oct. 3, 2008.*

PCT International Searching Authority, International Search Report and Written Opinion, dated Jul. 11, 2008 for corresponding International Application No. PCT/US07/17983.

Wang et al., "Superplasticity and superplastic forming ability of a Zr-Ti-Ni-Cu-Be bulk metallic glass in the supercooled liquid region," *Journal of Non-Crystalline Solids*, vol. 351, (2005), pp. 209-217.

(Continued)

*Primary Examiner* — George Wyszomierski
(74) *Attorney, Agent, or Firm* — Dorsey & Whitney LLP

(57) ABSTRACT

Amorphous metal foams and methods of making the same are provided. The amorphous metal foams have properties matching those of natural bone, enabling their use as bone replacement scaffolds. In one embodiment, for example, an amorphous metal foam has a density-dependent stiffness (or Young's modulus, denoted E) ranging from about $640\rho^{3.75}$ τo αβoυτ $2900\rho^{0.78}$, and a density dependent strength ($\sigma_y$) greater than about $8.1\rho^{2.57}$, wherein ρ (the density) is less than about 1.7 g/cc.

12 Claims, 13 Drawing Sheets
(9 of 13 Drawing Sheet(s) Filed in Color)

OTHER PUBLICATIONS

Kawamura et al., "Superplasticity IN $Pd_{40}Ni_{40}P_{20}$ Metallic Glass," *Scripta Materialia*, vol. 39, No. 3, pp. 301-306, 1998.
Gun et al., "Superplastic flow of a Mg-based bulk metallic glass in the supercooled liquid region," *Journal of Non-Crystalline Solids*, vol. 352, (2006), pp. 3896-3902.
Kawamura et al., "High-Strain-Rate Superplasticity due to Newtonian Viscous Flow in $La_{55}Al_{25}Ni_{20}$ Metallic Glass," *Materials Transactions, JIM*, vol. 40, No. 8 (1999), pp. 794-803.
Nieh et al., "Superplastic Behavior of a Zr-10Al-5Ti-17.9Cu-14.6Ni Metallic Glass in the Supercooled Liquid Region," *Scripta Materialia*, vol. 40, No. 9, pp. 1021-1027, 1999.
Masuhr et al., "Time Scales for Viscous Flow, Atomic Transport, and Crystallization in the Liquid and Supercooled Liquid States of $Zr_{41.2}Ti_{13.8}Cu_{12.5}Ni_{10.0}Be_{22.5}$," *Physical Review Letters*, vol. 82, No. 11, pp. 2290-2293, Mar. 15, 1999.
Kawamura et al., "Newtonian viscosity of supercooled liquid in a $Pd_{40}Ni_{40}P_{20}$ metallic glass," *Applied Physics Letters*, vol. 77, No. 8, pp. 1114-1116, Aug. 21, 2000.
Busch et al., "Thermodynamics and kinetics of the $Mg_{65}Cu_{25}Y_{10}$ bulk metallic glass forming liquid," *Journal of Applied Physics*, vol. 83, No. 8, pp. 4134-4141, Apr. 15, 1998.
Kawamura et al., "Newtonian and non-Newtonian viscosity of supercooled liquid in metallic glasses," *Materials Science & Engineering*, A304-306 (2001) 674-678.
Busch et al, "Thermodynamics and Kinetics of Bulk Metallic Glass," *MRS Bulletin*, vol. 32, pp. 620-623, Aug. 2007.

* cited by examiner

FIG. 8A
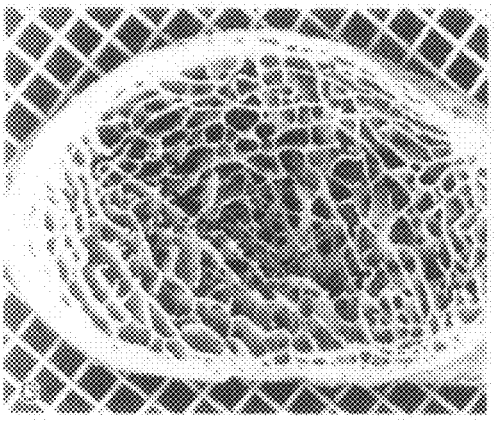
FIG. 8B
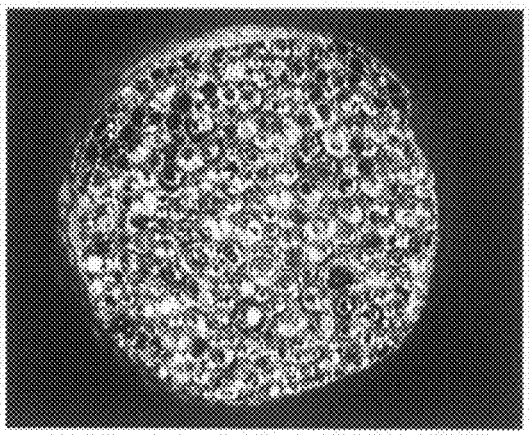
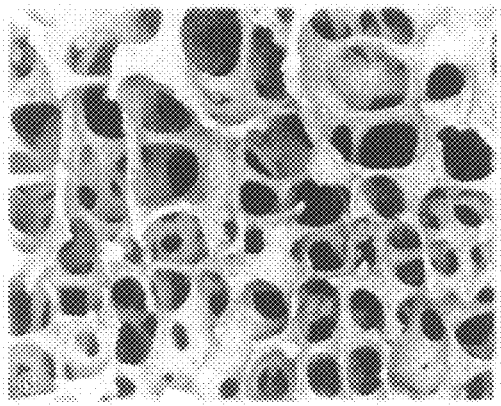
FIG. 8C
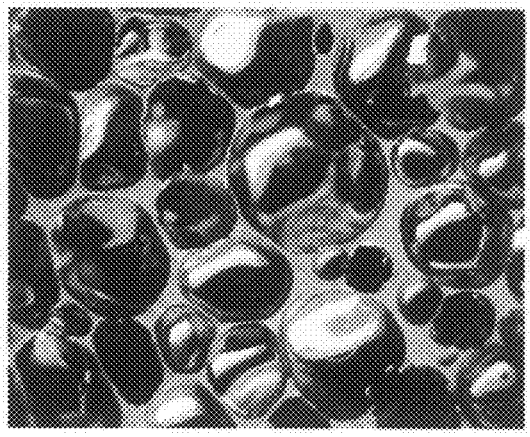
FIG. 8D

AMORPHOUS METAL FOAM AS A PROPERTY-MATCHED BONE SCAFFOLD SUBSTITUTE

CROSS-REFERENCE TO RELATED APPLICATION(S)

This application claims priority to and the benefit of U.S. Provisional Application Ser. No. 60/837,176 filed on Aug. 11, 2006, the entire content of which is incorporated herein by reference.

FIELD OF THE INVENTION

The invention is directed to amorphous metal foams having properties matching those of bone, enabling their use as bone replacements.

BACKGROUND OF THE INVENTION

Porous metallic scaffold substitutes for the replacement of damaged natural bone have been steadily gaining interest. Indeed, porous titanium and tantalum scaffold materials exhibiting good biocompatibility and bioactivity are currently commercially available. Nevertheless, from a mechanical perspective, these scaffolds are still considered inadequate for replicating the unique mechanical performance of natural bone, which is characterized by high strength, high specific strength, and low stiffness. This mechanical inadequacy is primarily attributed to the relatively low strength and high modulus of pure crystalline metals, which characteristics are inherited by the porous counterparts, resulting in poor replication of the load bearing capabilities of bone.

Another drawback of conventional porous metals is their inability to be processed into near-net-shapes, which is attributed to the poor superplasticity that characterizes conventional crystalline metals. Owing to this inability, the complexity of free-form fabrication of porous metallic scaffolds increases dramatically, resulting in substantially high manufacturing costs.

SUMMARY OF THE INVENTION

The invention is directed to amorphous metal foams (AMFS) having density-dependent stiffnesses and density-dependent strengths closely matching those of natural bone. Compared to crystalline metals, amorphous metals exhibit considerably higher strengths and notably lower moduli, suggesting a mechanical performance for their porous counterparts capable of closely replicating the load bearing capabilities of bone. More interestingly, the ability of amorphous metals to be "net-shaped" thermoplastically when softened gives rise to a potentially efficient scaffold fabrication technology.

In one embodiment, AMFs exhibit both density-dependent strengths and stiffnesses that fall inside the respective ranges for bone. For example, in one embodiment, an AMF exhibits a density-dependent stiffness that substantially matches that of bone, and exhibits a density-dependent strength that is substantially equal to or greater than that of bone. In one exemplary embodiment, the AMF exhibits a density-dependent stiffness ranging from about $E=640\rho^{3.75}$ to about $E=2900\rho^{0.78}$, where $\rho<1.7$ g/cc, and a density-dependent strength greater than about $\sigma_y=8.1\rho^{2.57}$, where $\rho<1.7$ g/cc.

The AMFs according to the present invention may be synthesized by any suitable method so long as the resulting AMF has the desired stiffness and strength properties. According to one exemplary embodiment, an AMF is produced by first producing a two-phase mixture of a suitable alloy in its liquid state and a chemically non-reacting propellant gas. The mixture is placed in an inert gas atmosphere under a pressure, $p_i$. The mixture is held a temperature $T_i$ that is greater than the optimum temperature for foaming, $T_o$. The mixture is then brought to the optimum temperature $T_o$, and foam expansion is induced by dropping the pressure to the optimum pressure, $p_o$, where $p_o<p_i$. The two-phase mixture is then quenched to a temperature below the glass transition temperature of the alloy, thereby producing an amorphous metal foam.

BRIEF DESCRIPTION OF THE DRAWINGS

The patent or application file contains at least one drawing executed in color. Copies of this patent or patent application publication with color drawing(s) will be provided by the office upon request and payment of the necessary fee.

The above and other features and advantages of the present invention will be better understood with reference to the following detailed description when considered in conjunction with the attached drawings in which:

FIGS. 8A and 8C are scanning electron microscope (SEM) photographs at different magnifications of the cellular morphology of natural bone;

FIGS. 8B and 8D are optical microscopy photographs at different magnifications of the cellular morphology of an amorphous metal foam according to one embodiment of the present invention;

DETAILED DESCRIPTION OF THE INVENTION

Figure 1A:
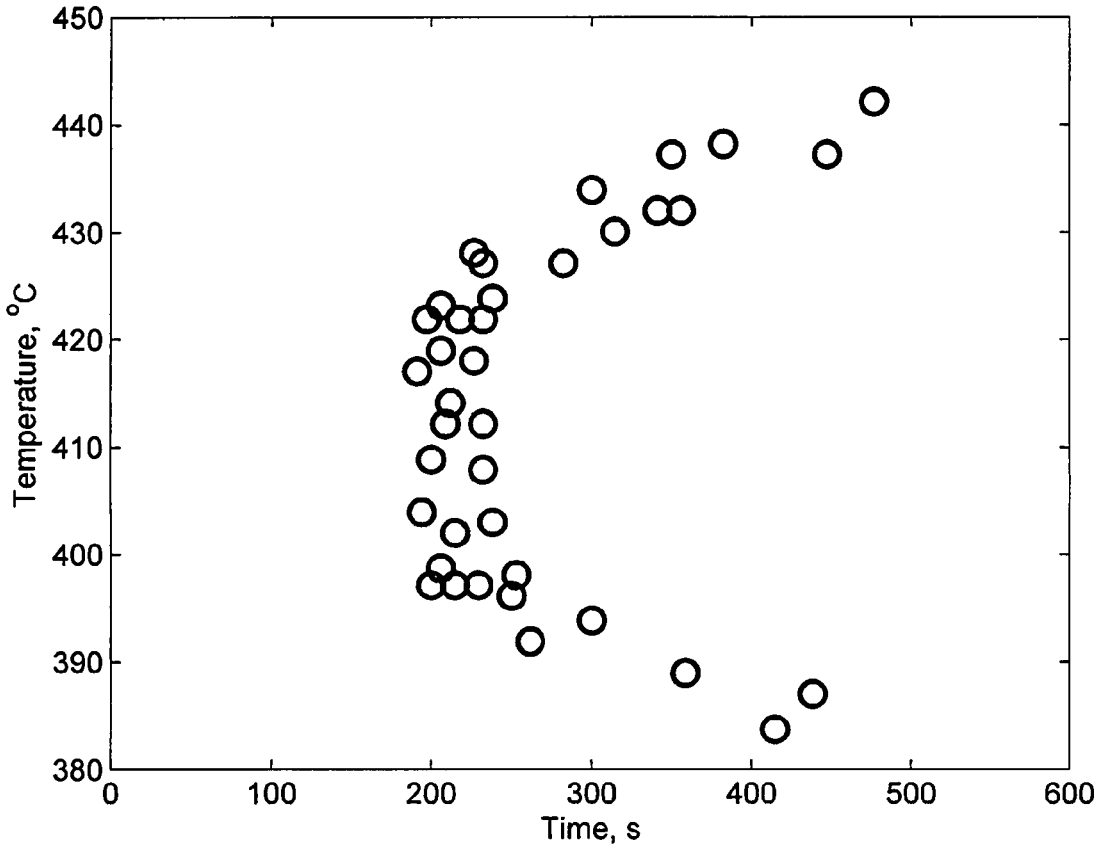
FIG. 1A is a time-temperature-transformation diagram of $Pd_{43}Ni_{10}Cu_{27}P_{20}$ liquid.

The present invention is directed to amorphous metal foams (AMFs) capable of matching the mechanical properties of bone. Over the last decade, interest has increased in metallic porous scaffold substitutes for bone tissue engineering applications. For bone replacements, porosity is desired for promoting bone ingrowth and attachment, reducing the overall implant density to match that of adjacent bone, and enhancing plastic deformability to replicate the deformation behavior of bone. Furthermore, successful scaffold materials should provide mechanical support in order to preserve tissue volume and ultimately to facilitate tissue regeneration. An optimal scaffold should therefore exhibit mechanical performance that closely resembles that of natural bone in order to replicate its load-bearing capabilities. The most essential mechanical properties to be matched by the scaffold are bone loading stiffness and strength.

When the scaffold's stiffness exceeds that of natural bone, stress concentration in the surrounding bone can cause bone failure. When the scaffold's stiffness is less than that of natural bone, stress concentration in the scaffold can cause implant failure as well as bone atrophy. This effect of stiffness mismatch, which gives rise to uneven load sharing between bone and implant, is known as stress shielding.

In addition to matching bone stiffness, the scaffold should also match or exceed the strength of natural bone. An equal or excess strength ensures that the implant has equivalent or better load bearing capabilities than natural bone.

Amorphous metals exhibit high strength and low stiffness compared to conventional crystalline metals. As such, amorphous metal foams (AMFs) may be suitable bone scaffold materials. For this purpose, two methods of producing structurally practical AMFs have been proposed. The first method synthesizes AMFs by precipitation of hydrogen dissolved in the liquid state (the "Inoue method"). The second method synthesizes AMFs by infiltration of salt performs and subsequent leaching of the salt (the "Dunand method").

Mechanical data has been reported for AMFs produced by the Inoue and Dunand methods. AMFs produced by the first method have density-dependent stiffnesses and strengths that are outside the respective ranges for bone. AMFs produced by the second method have density-dependent strengths that are inside the range for bone, but density-dependent stiffnesses that are outside the range for bone. Accordingly, neither the first nor the second methods have yet produced AMFs that would be desirable as bone replacements.

According to one embodiment of the present invention, AMFs exhibit both density-dependent strengths and stiffnesses that fall inside the respective ranges for bone. In particular, the AMFs exhibit density-dependent strengths and stiffnesses that closely match those properties in trabecular and/or cancellous bone. In one embodiment, for example, an AMF exhibits a density-dependent stiffness that closely matches that of bone, and exhibits a density-dependent strength that is equal to or greater than that of bone. In one exemplary embodiment, the AMF exhibits exhibit a density-dependent stiffness ranging from about $E=640\rho^{3.75}$ to about $E=2900\rho^{0.78}$, where $\rho<1.7$ g/cc. The AMF may also exhibit a density-dependent strength greater than about $\sigma_y=8.1\rho^{2.57}$, where $\rho<1.7$ g/cc. In the power-law relations given by $E=640\rho^{3.75}$, $E=2900\rho^{0.78}$, and $\sigma_y=8.1\rho^{2.57}$, E denotes the foam compressive loading stiffness (Young's Modulus) in MPa, $\sigma_y$ denotes the foam strength (failure stress) in MPa, and $\rho$ denotes the foam density in g/cc. Accordingly, in one embodiment of the present invention, an AMF has a density of less than about 1.7 g/cc, a compressive loading stiffness ranging from about $640\rho^{3.75}$ to about $2900\rho^{0.78}$, and a strength of greater than about $8.1\rho^{2.57}$.

In another embodiment of the present invention, the AMFs have specific stiffnesses substantially matching those of natural bone. In particular, the AMFs substantially match these properties in trabecular and/or cancellous bone. In one exemplary embodiment, an AMF has a density-dependent specific stiffness ranging from about $E_s=620\rho^{2.81}$ to about $E_s=2600$, where $\rho<1.7$ g/cc. The upper limit of $E_s=2600$ appears to be independent of density. In the power-law relation given by $E_s=620\rho^{2.81}$ to about $E_s=2600$, $E_s$ denotes the foam specific loading stiffness (i.e. Young's Modulus divided by density) in J/g, and $\rho$ denotes the foam density in g/cc.

According to yet another embodiment, the AMFs have specific strengths substantially equal to or greater than those of natural bone, and of trabecular or cancellous bone in particular. In one exemplary embodiment, an AMF has a density-dependent specific strength equal to or greater than about $\sigma_s=5.16\rho^{2.37}$, where $\rho<1.7$ g/cc. In the power-law relation given by $\sigma_s=5.16\rho^{2.57}$, $\sigma_s$ denotes the foam specific strength (i.e. compressive strength divided by density) in J/g, and $\rho$ denotes the foam density in g/cc.

The base solids of the AMFs according to embodiments of the present invention may be any metallic alloy composition that can form a vitrified amorphous state in bulk dimensions (i.e., greater than 1 mm), and that would result in the density-dependent foam strength and stiffness discussed above. Non-limiting examples of suitable alloy compositions include Zr-based alloys, Ti-based alloys, Al-based alloys, Ni-based alloys, Fe-based alloys, La-based alloys, Cu-based alloys, Ce-based alloys, Mg-based alloys, Au-based alloys, Pt-based alloys, and Pd-based alloys. One exemplary embodiment of a suitable alloy composition is $Pd_{43}Ni_{10}Cu_{27}P_{20}$.

The AMFs according to the present invention may be prepared by any suitable method so long as the resulting AMF exhibits the density-dependent strengths and stiffnesses discussed above. In general, AMFs may be prepared by one of the following methods: 1) expansion of powder compacts involving powder mixtures of the amorphous metal and a blowing agent; 2) precipitation of hydrogen dissolved in the liquid state; 3) infiltration of salt performs and subsequent leaching of salt; and 4) in situ decomposition of a metal hydride. However, these methods have not yet been able to produce an AMF having the desired density-dependent properties discussed above.

According to one exemplary embodiment of the present invention, an AMF having the desired density-dependent strength and stiffness properties is prepared by a new method involving the expansion of bubbles entrained in liquid or supercooled liquid. First, a two-phase mixture of a suitable alloy in its liquid state and a chemically non-reacting propellant gas is prepared. The mixture is placed in an inert gas atmosphere under a pressure, $p_i$. The mixture is held a temperature $T_i$ that is greater than the optimum temperature for foaming, $T_o$. The mixture is then brought to the optimum temperature $T_o$, and foam expansion is induced by dropping the pressure to the optimum pressure, $p_o$, where $p_o<p_i$. The two-phase mixture is then quenched to a temperature below the glass transition temperature of the alloy, thereby producing an amorphous metal foam.

In preparing AMFs according to this method, the parameters used may vary depending on the alloy used. In one embodiment, $T_i$ is any temperature above the glass transition temperature of the alloy, but above the melting point of the alloy. For example, for a $Pd_{43}Ni_{10}Cu_{27}P_{20}$ alloy, $T_i$ may be about 900° C. In another embodiment, $T_o$ may be any temperature above the glass transition temperature of the alloy, but between the nose of the time-temperature-transformation (TTT) curve and the melting point. For example, for a $Pd_{43}Ni_{10}Cu_{27}P_{20}$ alloy, $T_o$ may be about 420° C. According to yet another embodiment, $p_i$ may be the highest pressure allowed by the container holding the mixture at hydrostatic strength. For example, for a $Pd_{43}Ni_{10}Cu_{27}P_{20}$ alloy, $p_i$ may be about 1 bar. In still another embodiment, $p_o$ may be the lowest pressure attainable by mechanical evacuation. For example, for a $Pd_{43}Ni_{10}Cu_{27}P_{20}$ alloy, $p_o$ may be about 0.01 mbar.

The two-phase mixture used in the method may be generated by any suitable method of gas entrainment in a liquid. Nonlimiting examples of suitable such methods include mechanical entrapment, gas dissolution, and the use of gas releasing agents.

The chemically non-reacting propellant gas used in the alloy mixture may be any gas composition that can be entrained in the liquid but that does not react with it to substantially degrade its vitrifying ability or viscoplastic forming ability. Nonlimiting examples of suitable such gases include helium, argon, air, nitrogen, hydrogen, water vapor, carbon monoxide and carbon dioxide. When gas releasing agents are used, any gas releasing agent composition may be used that decomposes to release a gas that can be entrained in the liquid without chemically reacting with it to substantially degrade its vitrifying ability or viscoplastic forming ability. Nonlimiting examples of suitable such gas releasing agents include water vapor-releasing agents, hydrogen-releasing agents, carbon monoxide-releasing agents, carbon dioxide-releasing agents, and nitrogen-releasing agents.

This foam synthesis route utilizes a ductile yet viscous state of the undercooled liquid to develop amorphous metallic foams by expansion of entrained gas bubbles. Liquid ductility is desired to enable plastic elongation of membranes, while high liquid viscosity is required to inhibit bubble sedimentation during foaming. For undercooled liquids, ductility increases by increasing temperature while viscosity increases by decreasing temperature. Therefore, the optimum temperature for foaming, $T_o$, is that at which the liquid exhibits adequate ductility as well as adequately high viscosity. However, liquid stability against crystallization minimizes at intermediate temperatures in undercooled liquid regions, limiting the available time for processing at those temperatures. Therefore, the foaming time at $T_o$ is stringently constrained by rate of crystallization kinetics.

Figure 1B:
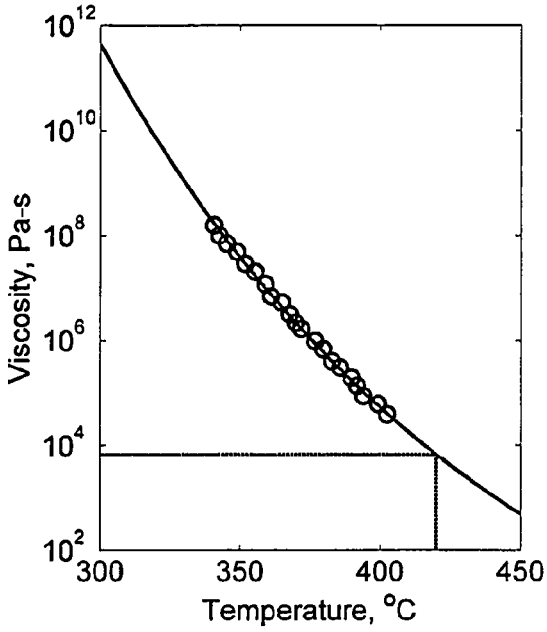
FIG. 1B is a plot of the temperature-dependent viscosity of $Pd_{43}Ni_{10}Cu_{27}P_{20}$ liquid.
Figure 1C:
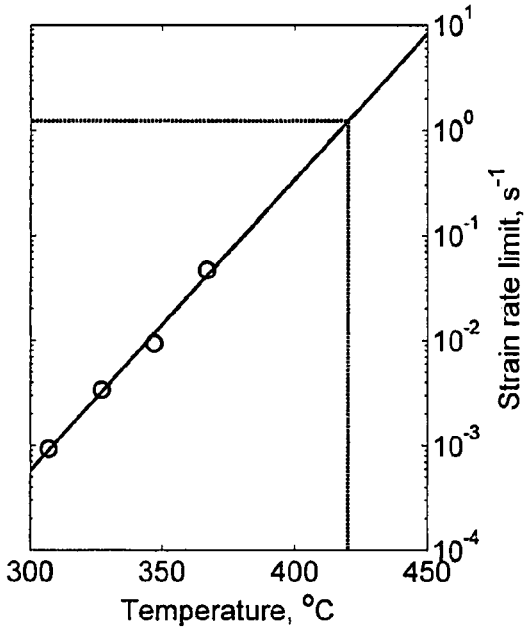
FIG. 1C is a plot of the limits of strain rate sensitivity of $Pd_{43}Ni_{10}Cu_{27}P_{20}$ liquid.

One example of an AMF produced by this method is described below in Example 1. In Example 1, $Pd_{43}Ni_{10}Cu_{27}P_{20}$ is used to prepare the AMF. As shown in the time-temperature-transformation (TTT) diagram in FIG. 1A, the $Pd_{43}Ni_{10}Cu_{27}P_{20}$ alloy has a 200 second time window at 420° C. which can be utilized for foaming. The temperature dependent viscosity of $Pd_{43}Ni_{10}Cu_{27}P_{20}$ liquid is shown in FIG. 1B. By extrapolation, the liquid viscosity at 420° C. is about $1\times10^{4}$ Pa-s, which is adequately high to inhibit microbubble floatation. FIG. 1C depicts the limits of strain rate sensitivity of $Pd_{43}Ni_{10}Cu_{27}P_{20}$ liquid. Within these strain rate limits, flow can be maintained Newtonian giving rise to ideal liquid ductility. By extrapolation, the strain rate limit at 420° C. is about 1 $s^{-1}$, which confines a range of liquid ductility that is adequately broad for foaming. Therefore, $T_o$ for $Pd_{43}Ni_{10}Cu_{27}P_{20}$ is 420° C.

Example 1 below illustrates one exemplary method of making an AMF from a $Pd_{43}Ni_{10}Cu_{27}P_{20}$ liquid. The following Examples are provided for illustrative purposes only and are not intended to limit the scope of the present invention.

Example 1

A $Pd_{43}Ni_{10}Cu_{27}P_{20}$ alloy ingot together with $H_3BO_3$ powder was enclosed in a quartz tube under 1-bar pressure of argon, and heated to 900° C. for approximately 3-5 minutes to facilitate gas release and entrainment in the liquid. The tube containing the mixture was then immersed in molten tin at 420° C., and allowed to stand for approximately 30-60 seconds to attain thermal equilibration. Then, pressure was reduced to below 0.01 mbar. Finally, the mixture was rapidly quenched in water.

Figure 2:
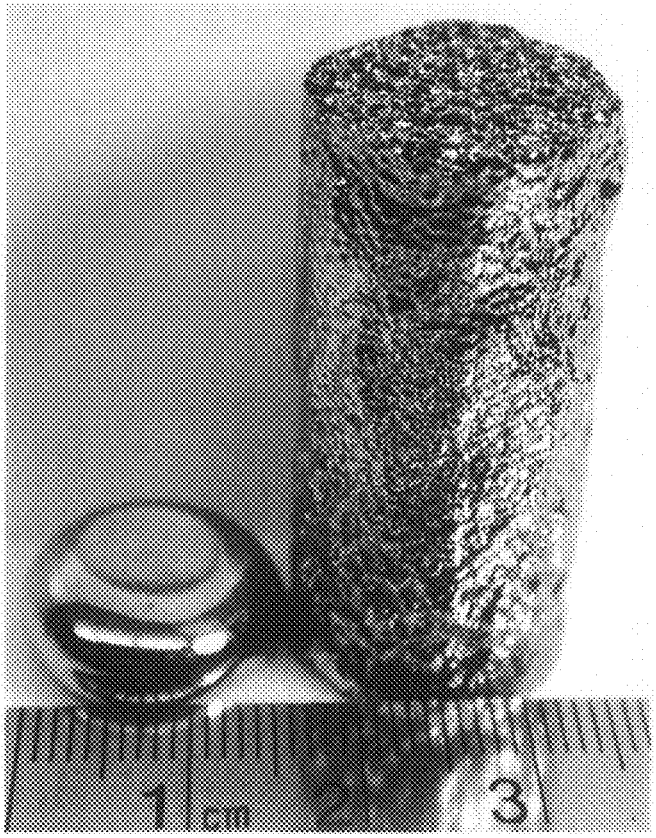
FIG. 2 is a photograph of an amorphous metal foam (AMF) produced according to Example 1 and having a density of 1.16 g/cc (88% porosity)
Figure 3:
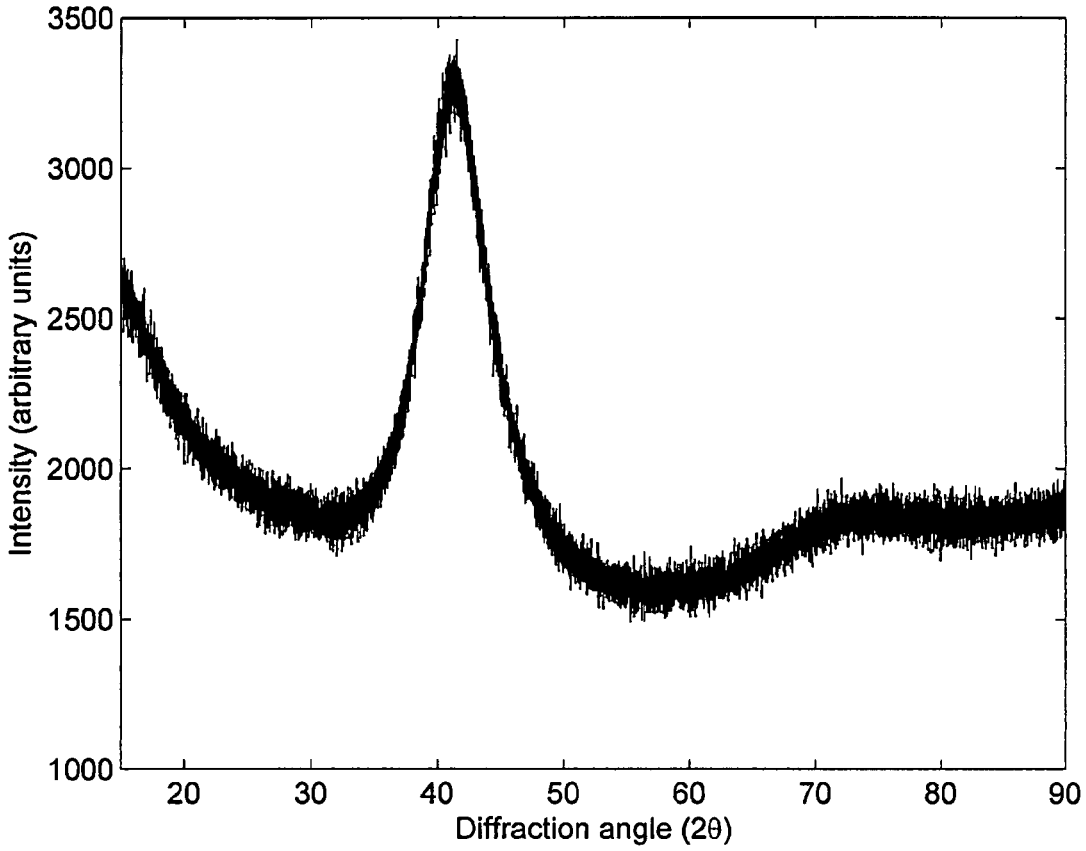
FIG. 3 is an X-ray diffractogram verifying the amorphous nature of the AMF produced according to Example 1 having a density of 1.16 g/cc.
Figure 4:
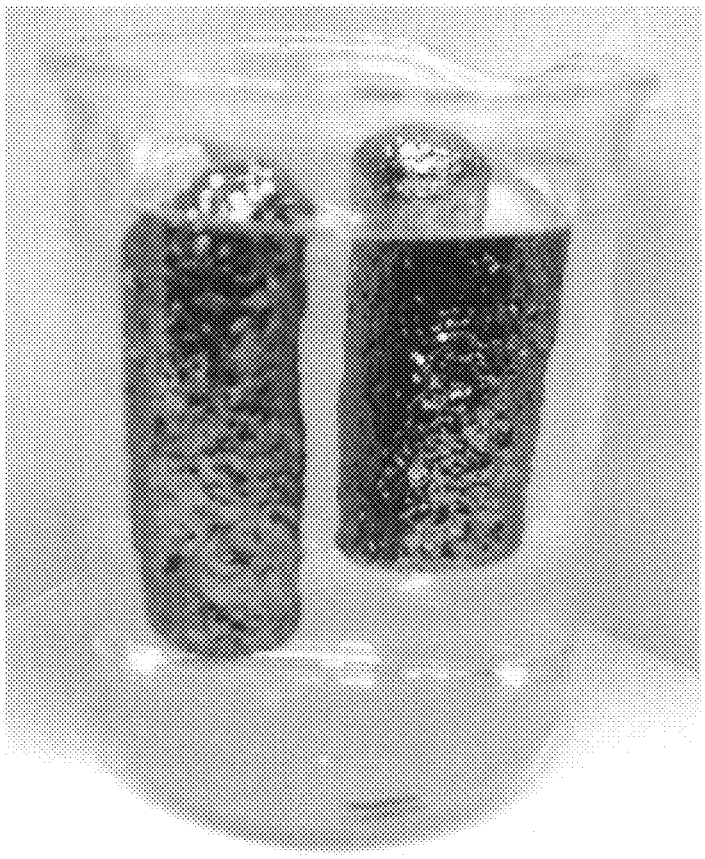
FIG. 4 is a photograph of two AMFs prepared according to Example 1 floating in water, each AMF having a density of 0.93 g/cc (90% porosity)

FIG. 2 is a photograph of the AMF produced according to Example 1. The AMF had a density of 1.16 g/cc (88% porosity). FIG. 2 also depicts a pore-free button of equivalent mass, which is shown to demonstrate the nearly 10-fold increase in volume produced by foaming. FIG. 3 is an x-ray diffractogram verifying the amorphous nature of the AMF produced according to Example 1. FIG. 4 depicts two other foams prepared according to Example 1, but having densities of 0.93 g/cc (90% porosity). As shown in FIG. 3, these foams float in water. The porosities of the foams produced according to Example 1 were assessed using the Archimedes method as well as the graphical method.

Figure 5:
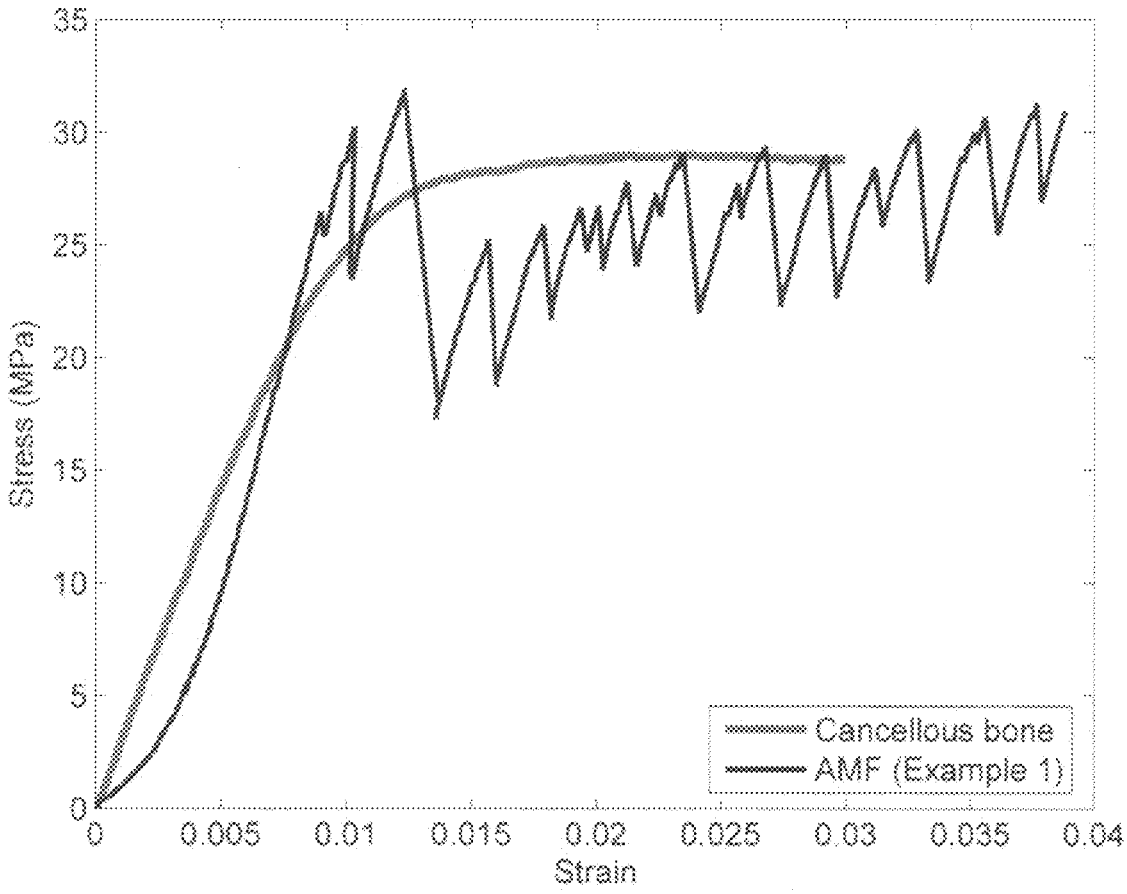
FIG. 5 is a graph comparing the compressive loading response of an amorphous metal foam prepared according to Example 1 to the compressive loading response of trabecular (or cancellous) bone.

FIG. 5 depicts a graph comparing the compressive loading responses of the AMF prepared according to Example 1 and trabecular bone. As evidenced by the stress-strain plots, the AMF prepared according to Example 1 closely matches the compressive loading response of bone.

Figure 6:
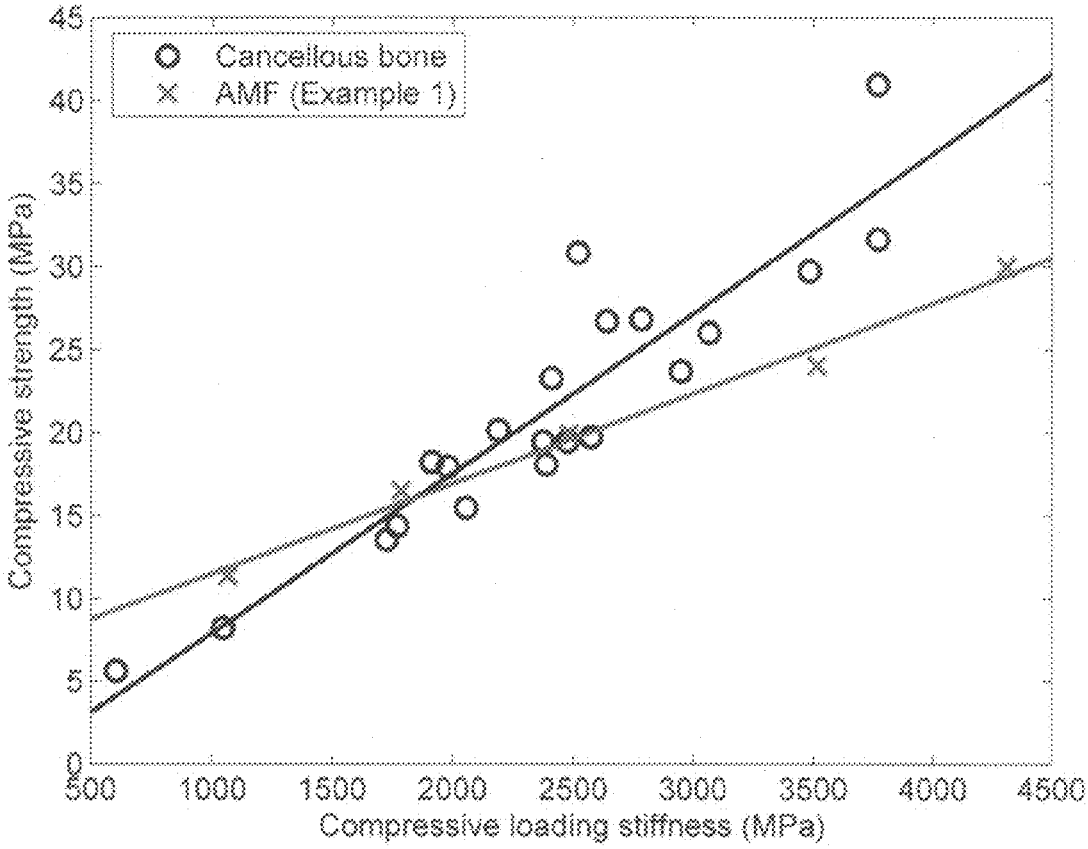
FIG. 6 is a graph comparing the compressive strength vs. Young's Modulus plot of an amorphous metal foam prepared according to Example 1 to the compressive strength vs. Young's Modulus plot of trabecular (or cancellous) bone.

In addition, in FIG. 6, the compressive strengths of the AMF prepared according to Example 1 and trabecular bone are plotted against their respective elastic moduli. The slopes of the compressive strength-elastic modulus plots constitute the elastic strain limits. As shown in FIG. 6, the slopes of the AMF prepared according to Example 1 and trabecular bone are comparable. Therefore, the AMF prepared according to Example 1 has elastic stability similar to bone.

The AMFs prepared according to Example 1 were compared with the reported data on AMFs prepared by precipitation of hydrogen dissolved in the liquid state (hereafter the "Inoue AMFs"). This method is described in detail in T. Wada, and A. Inoue, "Formation of Porous Pd-based Bulk Glassy Alloys by a High Hydrogen Pressure Melting-Water Quenching Method and Their Mechanical Properties," Mater. Trans. 46, 2777 (2005) and T. Wada, K. Takenaka, N. Nishiyama, and A. Inoue, "Formation and Mechanical Properties of Porous Pd—Pt—Cu—P Bulk Glassy Alloys," Mater. Trans. 46, 2777 (2005), the entire contents of which are incorporated herein by reference.

The AMFs prepared according to Example 1 were also compared with the reported data on AMFs prepared by infiltration of salt performs and subsequent leaching of salt (hereafter the "Dunand AMFs"). This method is described in detail in H. Brothers, and D. C. Dunand, "Ductile Bulk Metallic Glass Foams," Adv. Mater. 17, 484 (2005), H. Brothers, and D. C. Dunand, "Plasticity and Damage of Cellular Amorphous Metals," Acta Mater. 53, 4424 (2005), and H. Brothers, and D. C. Dunand, "Amorphous Metal Foams," Scripta Mater. 54, 513 (2006), the entire contents of which are incorporated herein by reference.

Figure 7A:
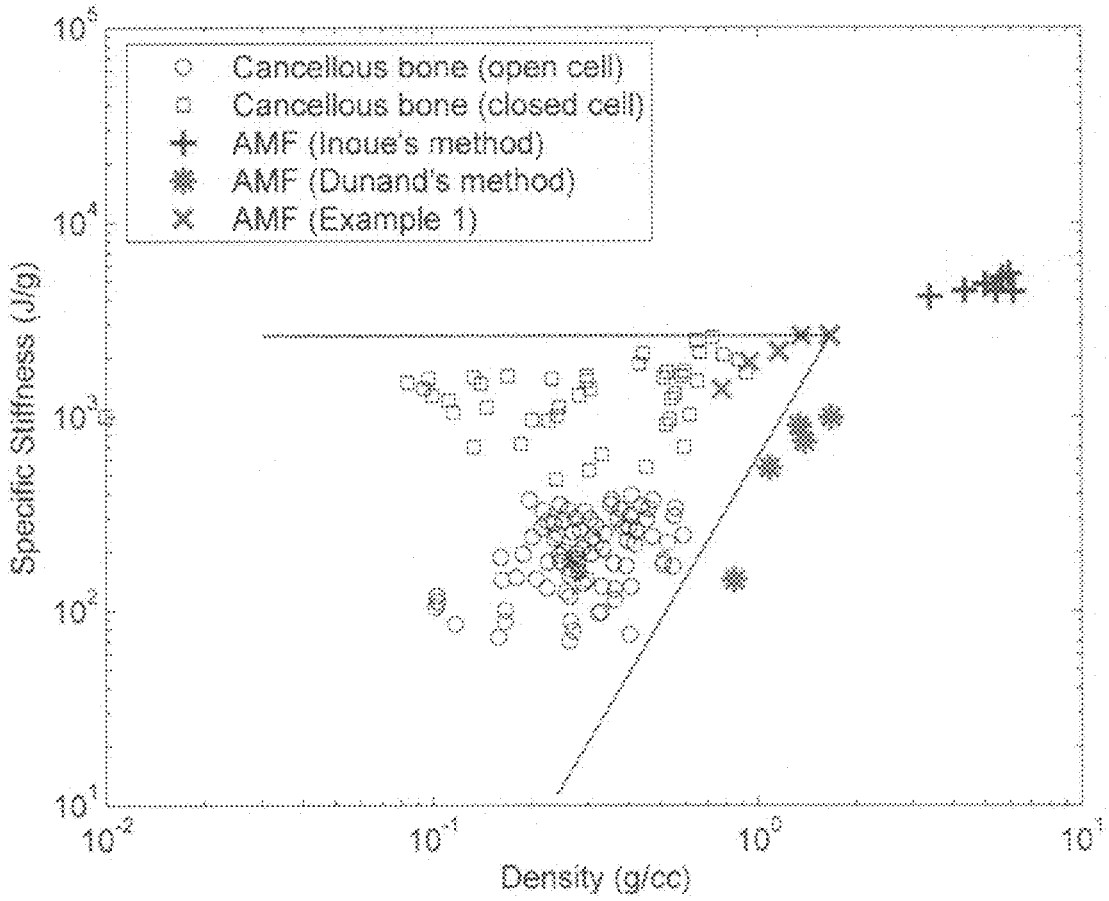
FIG. 7A is a graph comparing the specific stiffness vs. density plot of an amorphous foam prepared according to Example 1 to the specific stiffness vs. density plots of the Inoue and Dunand foams and to the specific strength vs. density plot of trabecular (or cancellous) bone.

FIG. 7A depicts a graph comparing the specific stiffnesses plotted against density of the AMF prepared according to Example 1 to the specific stiffnesses plotted against density of the Inoue and Dunand AMFs and the specific stiffnesses plotted against density of trabecular (or cancellous) bone. As shown in FIG. 7A, the AMF prepared according to Example 1 exhibits specific stiffnesses substantially matching those of bone. As also shown the upper limit of the specific stiffness appears to be independent of density (shown by the horizontal line in the drawing). In addition, as can be seen from FIG. 7A, the AMF prepared according to Example 1 matches the specific stiffness properties of bone much better than do the Inoue and Dunand AMFs.

Figure 7B:
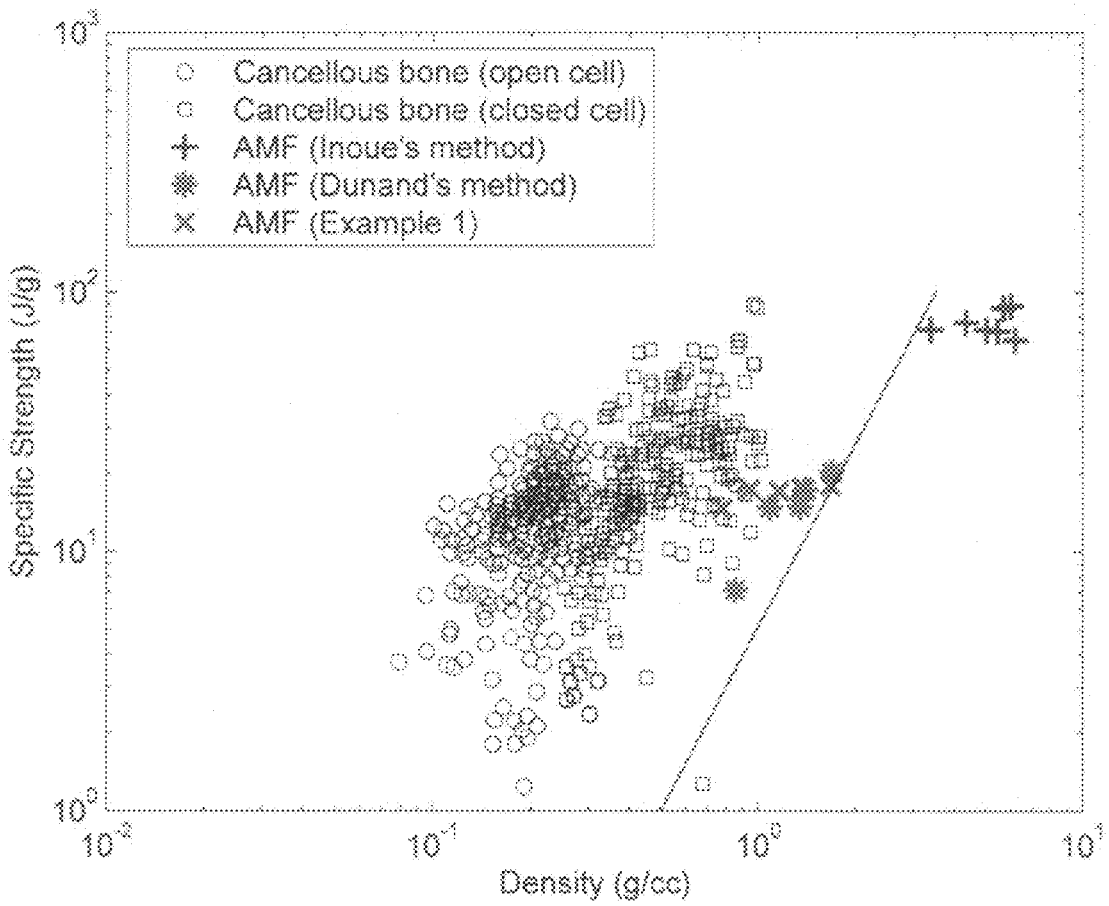
FIG. 7B is a graph comparing the specific strength vs. density plot of an amorphous foam prepared according to Example 1 to the specific strength vs. density plots of the Inoue and Dunand foams and to the specific strength vs. density plot of trabecular (or cancellous) bone.

FIG. 7B depicts a graph comparing the specific strengths plotted against density of the AMF prepared according to Example 1 to the specific strengths plotted against density of the Inoue and Dunand AMFs and the specific strengths plotted against density of trabecular (or cancellous) bone. As shown in FIG. 7B, the AMF prepared according to Example 1 exhibits specific strengths substantially matching those of bone. As also shown in FIG. 7B, the AMF prepared according to Example 1 matches the specific strength properties of bone much better than do the Inoue and Dunand AMFs.

FIGS. 8A and 8C are scanning electron microscope (SEM) photographs of the cellular morphology of natural bone, and FIGS. 8B and 8D are optical microscopy photographs of the cellular morphology of the AMF prepared according to Example 1. A comparison of the photographs in FIGS. 8A through 8D shows that the AMF produced according to Example 1 has a cellular morphology similar to that of natural bone. In the method of making an AMF outlined in Example 1, cell volume fraction and size distribution can be tailored by the foam processing parameters. As such, the closed cell architecture of the AMF is suitable for promoting cell attachment and migration.

Experimental Example 1

Figure 9:
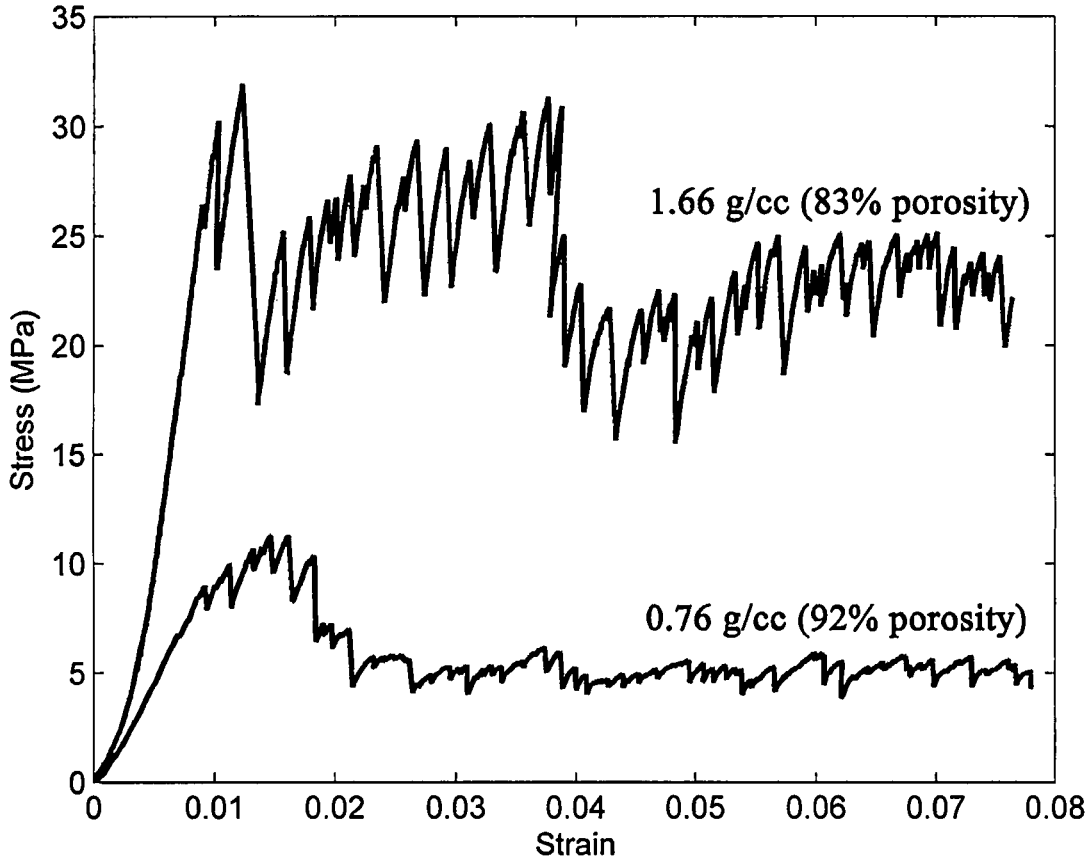
FIG. 9 is a graph of the compressive loading responses of AMFs produced according to Example 1 having densities of 1.66 g/cc (83% porosity) and 0.76 g/cc (92% porosity)

AMFs were prepared having densities ranging from 0.76 to 1.66 g/cc. Compressive testing of each AMF was performed. Cylindrical specimens with polished and parallel loading surfaces having diameters of 18 mm and heights ranging between 25 and 30 mm were prepared for mechanical testing. A servo-hydraulic Materials Testing System with a 50-kN load cell was utilized for the loading tests. Strain rates of $1\times10^{-4}\ s^{-1}$ were applied. Strains were measured using a linear variable displacement transducer (LVDT). The compressive loading responses of the 1.66 g/cc (83% porosity) and 0.76 g/cc (92% porosity) AMFs are shown in FIG. 9. The loading stiffness is taken to be the slope of the linear loading response prior to failure, while the strength is taken to be the peak stress at failure.

Figure 10:
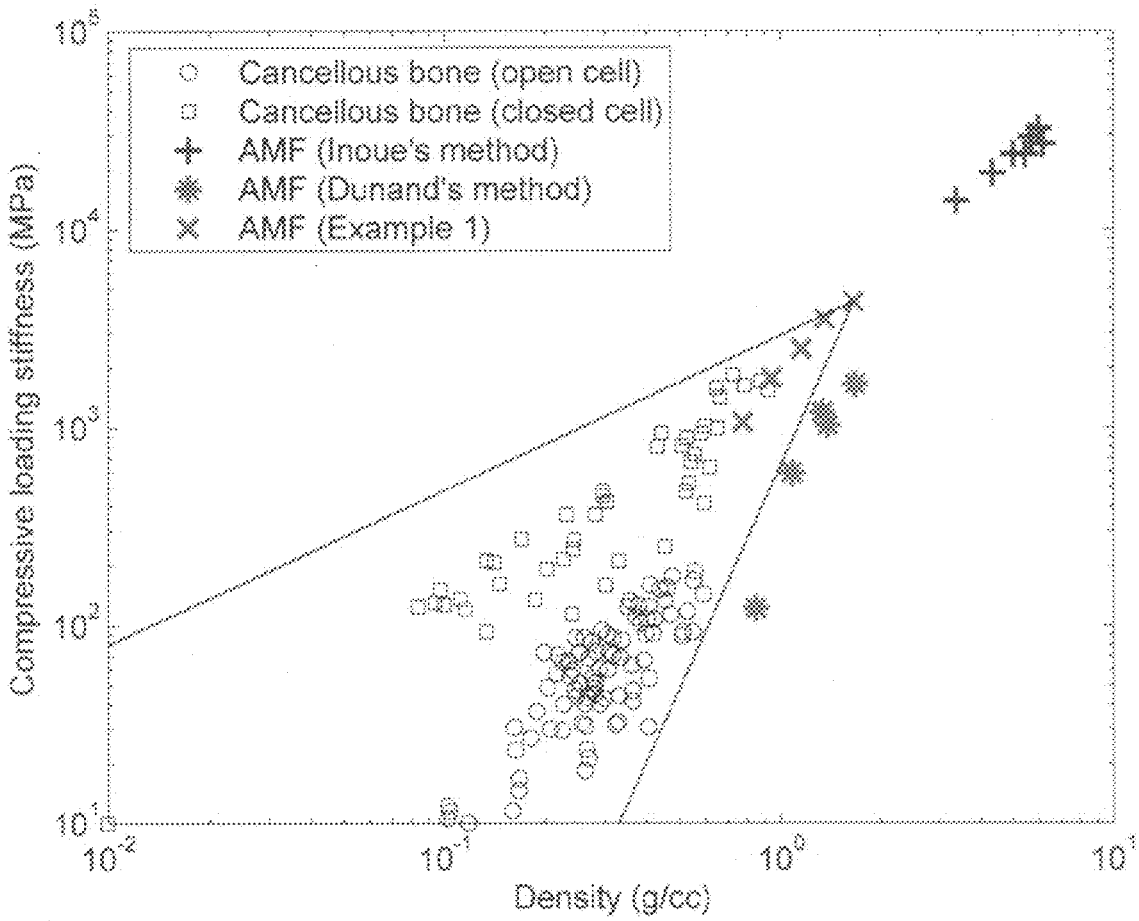
FIG. 10 is a graph comparing the density-dependent stiffness of the AMF produced according to Example 1 to the density-dependent stiffness of trabecular bone, the density-dependent stiffness of the Inoue AMFs and the density-dependent stiffness of the Dunand AMF.

FIG. 10 depicts a plot of density-dependent stiffness against that of bone. In FIG. 10, exemplary inventive AMFs having density-dependent stiffnesses ranging from $E=640\rho^{3.75}$ to about $E=2900\rho^{0.78}$ (where $\rho<1.7$ g/cc) are compared to natural bone and to the Inoue AMFs and Dunand AMFs. The dotted lines represent the upper and lower bounds of density-dependent stiffnesses according to the formulae $E=640\rho^{3.75}$ and $E=2900\rho^{0.78}$ (where $\rho<1.7$ g/cc). As shown in FIG. 10, the AMFs prepared according to Example 1 have density-dependent stiffnesses closely matching that of bone, but the Inoue AMFs and Dunand AMFs have density-dependent stiffnesses outside the range needed to match the density-dependent stiffness of bone.

Figure 11:
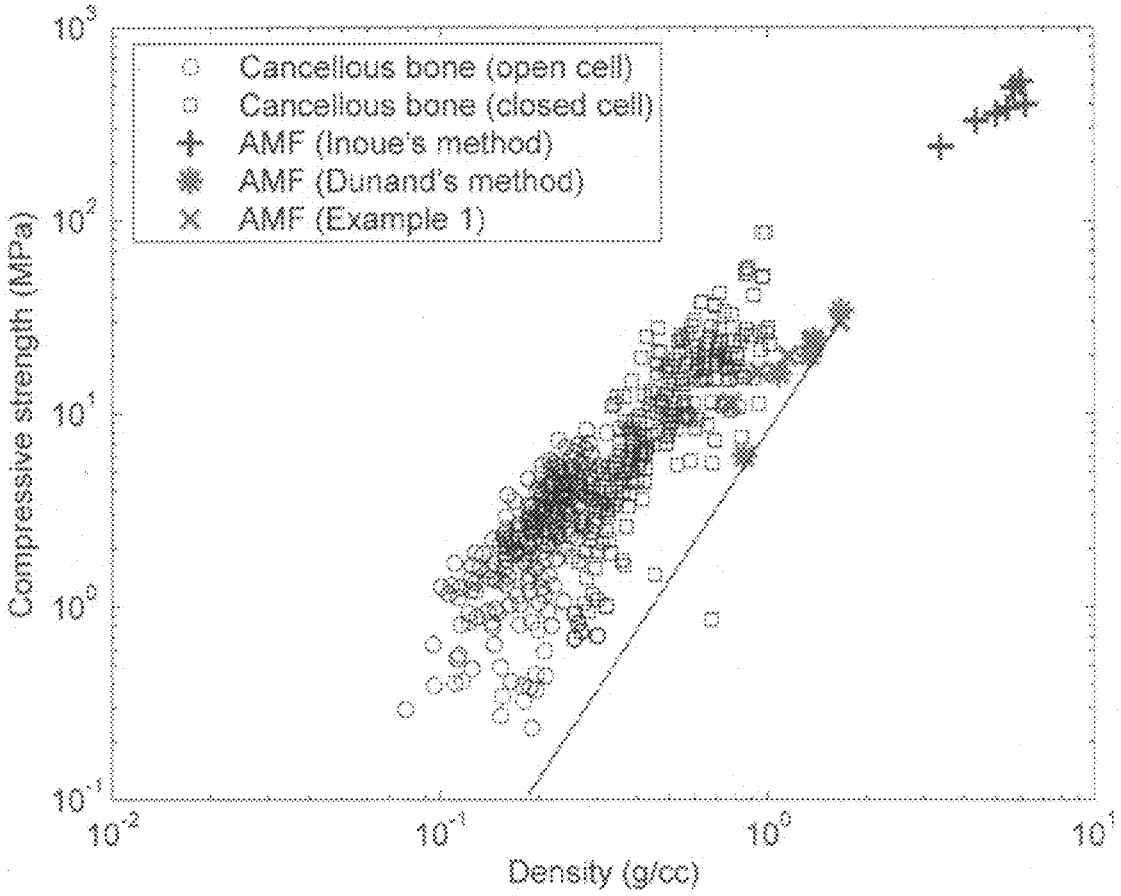
FIG. 11 is a graph comparing the density-dependent strength of the AMFs produced according to Example 1 to the density-dependent strength of trabecular bone, the density-dependent strength of the Inoue AMFs and the density-dependent strength of the Dunand AMFs.

FIG. 11 is a plot of density-dependent strength against that of bone. In FIG. 11, exemplary inventive AMFs having density-dependent strengths bounded above $\sigma_y=8.1\rho^{2.57}$ (where $\rho<1.7$ g/cc) are compared to natural bone and to the Inoue AMFs and Dunand AMFs. The dotted line represents the lower bound of density-dependent strength according to the formula $\sigma_y=8.1\rho^{2.57}$ (where $\rho<1.7$ g/cc). As shown in FIG. 11, the AMFs prepared according to Example 1 have density-dependent strengths closely matching those of bone. Accordingly, the AMF prepared according to Example 1 exhibits static load-bearing capabilities closely matching those of bone. As also shown in FIG. 11, while the Dunand AMFs have density-dependent strengths similar to that of bone, the Inoue AMFs do not. Even though the Dunand AMFs have density-dependent strengths similar to that of bone, these AMFs do not have density-dependent stiffnesses similar to that of bone (as shown in FIG. 6), and are thus rendered undesirable as bone replacements.

While the present invention has been illustrated and described with reference to certain exemplary embodiments, those of ordinary skill in the art understand that various modifications and changes may be made to the described embodiments without departing from the spirit and scope of the present invention as defined by the following claims.

What is claimed is:

1. An amorphous metal foam formed from the expansion of bubbles entrained in the undercooled liquid of the amorphous metal at a temperature above the glass transition temperature, but below the melting temperature of the amorphous metal, wherein the amorphous metal foam having a cell volume fraction and size distribution substantially matching that of natural bone, and comprising a density-dependent stiffness in units of megapascal ranging from about $640\rho^{3.75}$ to about $2900\rho^{0.78}$, and a density dependent strength in units of megapascal greater than about $8.1\rho^{2.57}$, wherein $\rho$ is the density in units of g/cc and is less than about 1.7 g/cc.

2. The amorphous metal foam according to claim 1, further comprising a density-dependent sound velocity substantially matching a density-dependent sound velocity of natural bone.

3. The amorphous metal foam according to claim 1, wherein the amorphous metal foam comprises an amorphous alloy selected from the group consisting of Zr-based alloys, Ti-based alloys, Al-based alloys, Fe-based alloys, La-based alloys, Cu-based alloys, Ce-based alloys, Mg-based alloys, Au-based alloys, Pt-based alloys and Pd-based alloys.

4. The amorphous metal foam according to claim 1, wherein the amorphous metal foam comprises an amorphous Pd-based alloy.

5. The amorphous metal foam according to claim 4, wherein the amorphous Pd-based alloy is $Pd_{43}Ni_{10}Cu_{27}P_{20}$.

6. A method of making an amorphous metal foam, the method comprising:

mixing a metal alloy liquid with a chemical non-reacting propellant gas to form bubbles;

sealing the mixture in a container in an inert gas atmosphere at an initial pressure;

holding the mixture at an initial temperature above a glass transition temperature of the metal alloy and above a melting point of the metal alloy;

reducing the temperature of the mixture to an optimum temperature above the glass transition temperature of the metal alloy and below the melting point of the metal alloy;

holding the mixture at the optimum temperature for a duration no longer than the time required to crystallize the alloy at that temperature while reducing the initial pressure to an optimum pressure below the initial pressure to effect expansion of the bubbles; and quenching the mixture to a final temperature below the glass transition temperature of the metal alloy to produce an amorphous metal foam.

7. The method according to claim 6, wherein the propellant gas is selected from the group consisting of helium, argon, air, nitrogen, hydrogen, water vapor, carbon monoxide and carbon dioxide.

8. The method according to claim 6, wherein the metal alloy is selected from the group consisting of Zr-based alloys, Ti-based alloys, Al-based alloys, Fe-based alloys, La-based alloys, Cu-based alloys, Ce-based alloys, Mg-based alloys, Au-based alloys, Pt-based alloys and Pd-based alloys.

9. The method according to claim 6, wherein the metal alloy is a Pd-based alloy.

10. The method according to claim 9, wherein the Pd-based alloy is $Pd_{43}Ni_{10}Cu_{27}P_{20}$.

11. The method according to claim 6, wherein the amorphous metal foam comprises a density-dependent sound velocity substantially matching a density-dependent sound velocity of natural bone.

12. The method according to claim 6, wherein the amorphous metal foam comprises a density-dependent stiffness in units of megapascal ranging from about $640\rho^{3.75}$ to about $2900\rho^{0.78}$, and a density dependent strength in units of megapascal greater than about $8.1\rho^{2.57}$, wherein $\rho$ is the density in units of g/cc and is less than about 1.7 g/cc.

* * * * *